US005778781A

United States Patent [19]

Mueller

[11] Patent Number: 5,778,781

[45] Date of Patent: Jul. 14, 1998

[54] METHOD AND APPARATUS FOR PRINTING ON OPPOSITE SIDES OF A WEB

[75] Inventor: Henry J. Mueller, Wrentham, Mass.

[73] Assignee: F. L. Smithe Machine Company, Inc., Duncansville, Pa.

[21] Appl. No.: 833,304

[22] Filed: Apr. 4, 1997

[51] Int. Cl.[6] ..... B41F 5/12; B41F 7/04

[52] U.S. Cl. ..... 101/220; 101/224; 101/229

[58] Field of Search ..... 101/220, 229, 101/223, 225, 254, 289, 179

[56] References Cited

U.S. PATENT DOCUMENTS

| | | | |
|---|---|---|---|
| 3,013,527 | 12/1961 | Novick | 118/262 |
| 3,431,842 | 3/1969 | Winkler et al. | 101/142 |
| 3,570,398 | 3/1971 | Mowry | 101/231 |
| 3,616,751 | 11/1971 | Mowry | 101/220 |
| 3,769,910 | 11/1973 | Heimlicher et al. | 101/177 |
| 5,031,530 | 7/1991 | Burger | 101/211 |
| 5,088,407 | 2/1992 | Helm et al. | 101/350 |
| 5,161,463 | 11/1992 | Knauer et al. | 101/220 |

FOREIGN PATENT DOCUMENTS

| | | | |
|---|---|---|---|
| 0023990 | 7/1980 | European Pat. Off. | B41F 13/02 |
| 1436541 | 10/1969 | Germany . | |
| 2949872 | 7/1980 | Germany | 101/220 |
| 58-160155 | 9/1983 | Japan | B41J 3/00 |
| 62-50141 | 3/1987 | Japan | B41F 31/34 |
| 2-235746 | 9/1990 | Japan . | |
| 2069932 | 9/1981 | United Kingdom | B41F 31/00 |

*Primary Examiner*—Edgar S. Burr
*Assistant Examiner*—Daniel J. Colilla
*Attorney, Agent, or Firm*—Price & Adams

[57] ABSTRACT

A continuous web of material is unwound from a roll by driven pull rolls that feed the web material to a printing unit in a feedline of an envelope making machine. The printing unit prints a selected one of the inside surface and the outside surface of the web before the web is cut and folded to form envelopes. The printing unit is supported by a base which is mounted for pivotal movement on a platform of a fixed frame member. The base is connected to the platform by a vertical pivot pin for movement through a 180° between a first position for printing the inside surface of the web and a second position for printing the outside surface of the web. The base of the printer is locked to the platform in the selected one of the first and second positions to perform the desired printing operation. The web is fed between counter-rotating impression and plate cylinders rotatably mounted and driven on the printer base. A film of ink is transferred by an anilox roll on the printer base to the plate cylinder which transfers the inked image to either the inside or outside surface of the web. To reverse the printing to the opposite surface of the web, the printer base is unlocked from the platform and pivoted about the pivot pin to move the plate cylinder to the opposite side of the web. The base is then locked to the platform, and the printing operation is resumed. With this arrangement, a single printing unit is used to print both surfaces of the web material.

20 Claims, 8 Drawing Sheets

METHOD AND APPARATUS FOR PRINTING ON OPPOSITE SIDES OF A WEB

BACKGROUND OF THE INVENTION

1. Field of the Invention

This invention relates to method and apparatus for printing on both sides of continuous web material by reversing the position of a rotary printer and, more particularly, to a printer for an envelope making machine having a printing unit pivotally mounted on a frame for printing both the inside and the outside of the web material for forming envelope blanks.

2. Description of the Prior Art

Rotary presses for printing both continuous web material and sheet material are well known in the art as disclosed in U.S. Pat. Nos. 3,616,751 and 3,570,398. In multicolor perfection presses two printing units are arranged in tandem and are operatively connected by transfer cylinders. With this arrangement, sheet material is fed to a first printing unit from one end of the press and is printed on one side in the first printing unit. The material is thereafter transferred to the tandemly arranged second printing unit by transfer cylinders. The transfer cylinders are operable to transfer the sheet material to the second printing unit with the reverse side of the material presented to the second printing unit. Other known printing mechanisms for printing both surfaces of sheet material include offset-printing, flexo printing, doctor blade printing, UF printing and others.

The basic module for a rotary printer that is either sheet fed or web fed includes an impression cylinder, a plate or type cylinder positioned adjacent to the impression cylinder and a suitable ink applicator roll associated with the plate cylinder, such as an anilox roll. An ink supply or fountain roll is positioned adjacent to the anilox roll and supplies ink to the surface of the anilox roll. A distributor blade or doctor blade assembly distributes the ink in a uniform film on the surface of the anilox roll.

The sheet or web material passes between the impression cylinder and the plate cylinder with the inked image on the plate cylinder transferred onto the surface of the blank. The web or sheet material is fed between the impression cylinder and the plate cylinder at a speed determined by the rotation of the impression cylinder. With each revolution of the plate cylinder an image is transferred onto the passing web or sheet. The amount of ink transferred onto the paper is determined by the doctor blade assembly that controls the film of ink applied to the anilox roll.

The above described rotary printer is conventional on envelope machines used to manufacture envelopes cut from web material that is unwound from a roll. The web material is fed to the rotary printer where a selected side of the web is printed as disclosed in U.S. Pat. No. 5,088,407. This includes color printing as well.

In an envelope making machine, printing on one web surface is referred to as inside printing and printing on the opposite web surface is referred to as outside printing. The inside surface corresponds to the inside of the envelope blank, and the outside surface corresponds to the outside of the envelope blank. Both the inside and outside printing operations can be multicolor.

It is conventional practice to use a pair of printing modules in tandem, one for inside printing and a second for outside printing. In other words, the first printer prints on one side of the web, and the second printer prints on the other or reverse side of the web. Also for multicolor printing, a pair of units are arranged in tandem for inside printing. A second pair of printing tandem modules are used for multicolor outside printing.

When a rotary press is arranged for two-color printing, the same side of the web or sheet is printed by the first and second printing units so that only one side of the sheet is printed in both printing units. Printing both sides of the sheet by a pair of tandem printers is generally referred to as "perfecting" wherein both sides of a sheet are printed by one pass through a pair of printing modules. Two-color and perfecting printing are disclosed in greater detail in U.S. Pat. No. 3,570,398.

A number of other arrangements have been proposed for printing on both sides of sheet or web material. For example, U.S. Pat. No. 5,161,463 discloses an offset printing machine in which a plurality of cylinders are moved into and out of engagement to provide various combinations of blanket and impression cylinders for printing on one side of the web and then on the other side of the web. The printer is not reversible from printing the inside to the outside and only allows control of one of the images to be printed so that one pair of blanket cylinders always prints images on one side of the web and another pair of blanket cylinders print on the other side of the web. U.S. Pat. No. 5,031,530 discloses a similar arrangement for offset printing where blanket cylinders are movable between three positions.

In U.S. Pat. No. 3,769,910 a rubber cylinder is pivotally connected to a plate cylinder by side plates in an offset printing press. By pivoting the side plates, the relative position between the rubber cylinder and the plate cylinder is changed to allow printing on both sides of the sheet.

German Patent No. 1,436,541 discloses a rotary printer having exchangeable printing units which engage the main drive for a selected format. Each of the geared cylinders is movably positioned on the machine frame sidewalls to allow conversion for printing on one side of the web to printing on the other side of the web.

UK Patent Application No. 2,069,932 discloses a printing press having a pair of printing units that are used to print on either side of a web or twice on the same side of the web. This is accomplished by providing one of the printing units with a reversible transfer roller which allows the direction of the printer to be reversed. The printing units are stationary, and the web material is fed through one of them in reverse with the required reversal of the transfer roller performed simultaneously.

Japanese Patent No. 62-50141 discloses a printing unit which can be changed from double-sided printing to single-sided printing. A solenoid and a cam independently move a form cylinder into and out of engagement with a plate cylinder. No physical movement or pivoting of the printing units is accomplished.

Japanese Patent No. 58-160155 discloses a printer that simultaneously prints data on both surfaces of the sheet. European Patent Application No. 23-990 discloses a further example of an offset rotary printing machine having rubber rollers mounted on swinging arms that permit adjustments in the position of the rollers on the machine frame.

While it is known to print multiple colors on one side of a web as well as printing on both sides of a web, the printing modules must be arranged in a selected combination. Single printers are arranged in tandem for inside and outside printing, or a first pair of printers are arranged in tandem for either inside or outside printing. The printers are fixed in position in the feedline for printing on one or the other side of the web. To convert from one type of printing to another requires that the web be rerouted to pass through the modules designated for printing on the selected side of the web. It is not known in an envelope making machine to convert a printer between inside and outside printing. Therefore, there is need in web fed printing operations for a rotary printer convertible for printing both surfaces of the web material.

SUMMARY OF THE INVENTION

In accordance with the present invention, there is provided a reversible printer for printing both sides of continuous web material that includes a support frame having a platform. A printer base is positioned on the support frame platform. A rotatably driven impression cylinder is supported by the printer base. A rotatable driven plate cylinder is supported by the printer base to receive sheet material fed between the impression cylinder and plate cylinder for printing. The plate cylinder has an inked surface for transferring an inked image to one side of the sheet material. The printer base is pivotally mounted on the support frame platform for movement through 180° to reverse the position of the impression cylinder and the plate cylinder to print one side of the web material in a first position of the printer base and the opposite side of the web material in a second position of the printer base pivoted from the first position.

Further in accordance with the present invention, there is provided a method for printing on opposite surfaces of continuous web material that includes the steps of positioning an impression cylinder and a plate cylinder on a platform to receive web material fed thereto. The impression cylinder and plate cylinder are rotated in opposite directions to feed the web material therebetween. A film of ink is transferred to the surface of the plate cylinder for printing an inked image on one surface of the web material as the web material is fed between the impression and plate cylinders. The impression cylinder and plate cylinder are turned on the platform to position the plate cylinder for printing the opposite surface of the web material when a film of ink is transferred to the plate cylinder upon rotation of the impression and plate cylinders.

Additionally the present invention is directed to a rotary printer for an envelope machine that includes a support frame having a platform. The support frame receives a web fed from a source. A printer base is positioned on the support frame platform. The printer base is connected to the support frame platform for pivotal movement in a horizontal plane through 180° between a first position and a second position. An impression cylinder is rotatably supported on the printer base for receiving the moving web on the surface of the impression cylinder. A plate cylinder is rotatably supported adjacent to the impression cylinder on the printer base for receiving the web fed between the plate cylinder and the impression cylinder. An anilox roll is rotatably supported in contact with the plate cylinder on the printer base. An ink distributing mechanism is supported by the printer base for transferring onto the surface of the anilox roll a film of ink for transfer to the plate cylinder for printing an image on one side of the web when the printer is in the first position. Drive means transmits rotation from the impression cylinder to the plate cylinder and the anilox roll to transfer an inked image on the plate cylinder to the surface of one side of the web moving between the impression cylinder and the plate cylinder. The printer base upon rotation to the second position on the support frame platform reverses the position of the impression cylinder and the plate cylinder for printing an image on an opposite side of the web.

Accordingly, a principal object of the present invention is to provide for web printing operations a rotary printing unit that is supported for movement on a frame between two positions for printing on both sides of the web without having to use multiple printing units to print each side of the web or reroute the web from one printing unit to another.

Another object of the present invention is to provide method and apparatus for printing both sides of web material by a single rotary printer.

An additional object of the present invention is to provide a rotary printer mounted to reverse the position of the impression cylinder and the plate cylinder in a web feedline to provide inside and outside printing of web material in an envelope making machine.

Another object of the present invention is to provide a rotary printer that is positioned for movement between two positions on a support frame to selectively print both sides of web material in which the various modules of the printer are driven by conventional drive mechanisms.

These and other objects of the present invention will be more completely disclosed and described in the following specification, the accompanying drawings, and the appended claims.

DESCRIPTION OF THE PREFERRED EMBODIMENTS

Figure 1:
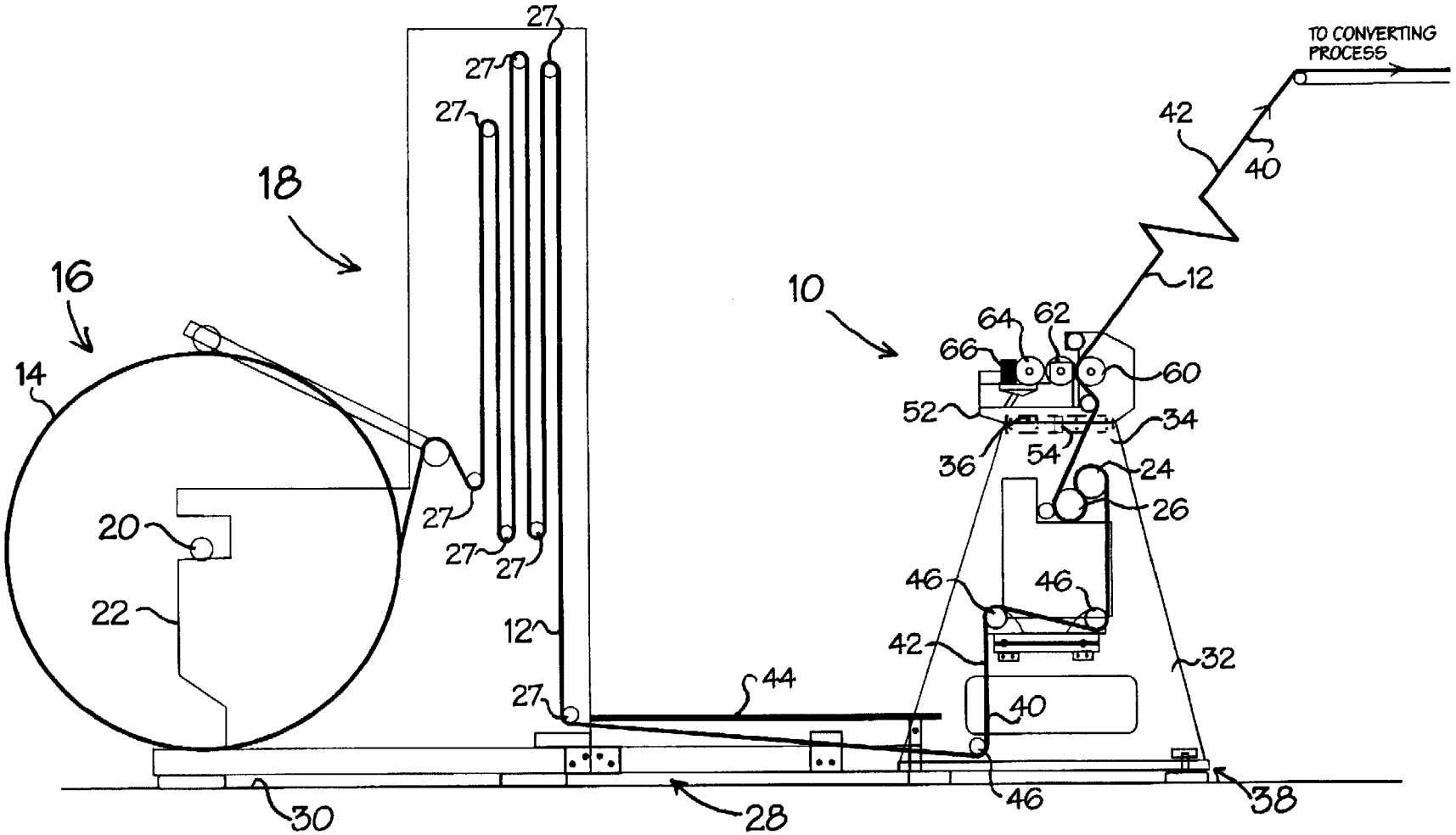
FIG. 1 is a view in side elevation of a web feeder and printer for feeding printed web material to a machine for making envelopes, illustrating a rotary printer pivotally mounted on a frame for printing both surfaces of the web material.

Referring to the drawings and particularly to FIG. 1, there is illustrated a rotary printing unit generally designated by the numeral 10 for receiving web material 12 continuously unwound from a roll 14 in a web supply unit generally designated by the numeral 16. The web 12 is continuously fed through a web unwind unit generally designated by the numeral 18 to the printing unit 10.

The roll of web material 14 is mounted on a shaft 20 rotatably supported in a frame 22 of the supply unit 16. Pull rolls 24 and 26 on the printing unit 10 unwind the web material 12 from the roll 14 through the unwind unit 18. The web 12 is fed from the roll 14 at a preselected linear speed through the printing unit 10. As the web 12 is drawn from the roll 14, the unwind unit 18 maintains a uniform tension in the web.

In the unwind unit 18 the web 12 passes around a series of idler rolls and pressure rolls 27 that are responsive to changes in the tension exerted on the web 12 as it is unwound from the roll 14 through the printing unit 10 to the subsequent stations in an envelope making machine (not shown). The unwind unit 18 responds to variations in pressure exerted on the web 12 as a result of changes in the tension of the web material being fed into the envelope making machine. Thus, a uniform web tension is maintained on the web material 12 being drawn into the envelope making machine. The details of the unwind unit and the web tension sensing mechanism are beyond the scope of the present invention and are illustrated and described in greater detail in U.S. Pat. No. 3,826,442 which is incorporated herein by reference.

The web material 12 is fed through the printing unit 10 for printing one or more colors on either surface of the web 12, also known as inside and outside printing in an envelope making machine. From the printing unit 10, the printed web 12 is conveyed in the direction indicated by the arrow through the various sections of the envelope making machine for converting the web into envelopes of a selected configuration. The printing unit 10 of the present invention is adaptable for use on a conventional envelope making machine as disclosed in U.S. Pat. No. 5,088,407 which is also incorporated herein by reference.

As further illustrated in FIG. 1, the web material 12 is fed from the web unwind unit 18 to the rotary printing unit 10. The rotary printing unit 10 includes a support frame generally designated by the numeral 28 mounted on floor 30. The frame 28 includes an upstanding member 32 having an upper end portion 34 with a fixed platform 36 maintained in substantially horizonal position by a leveling mechanism generally designated by the numeral 38. The leveling mechanism 38 extends between the support frame 28 and the upstanding member 32. By adjusting the leveling mechanism 38, the platform 36 is maintained in substantially horizonal position for supporting the printing unit 10.

In accordance with the present invention, the printing unit 10 is mounted on the support platform 36 to allow positioning of the unit 10 for printing on either surface (inside or outside) of the web 12. The web 12, as illustrated in FIG. 1, has a first surface 40 and an opposite or second surface 42. In the manufacture of envelope blanks, the first surface 40 is also referred to as the outside surface, and the second surface 42 is referred to as the inside surface, corresponding to the respective sides of the envelope blanks cut from the web 12 and folded into the desired shape of envelopes.

Figure 2:
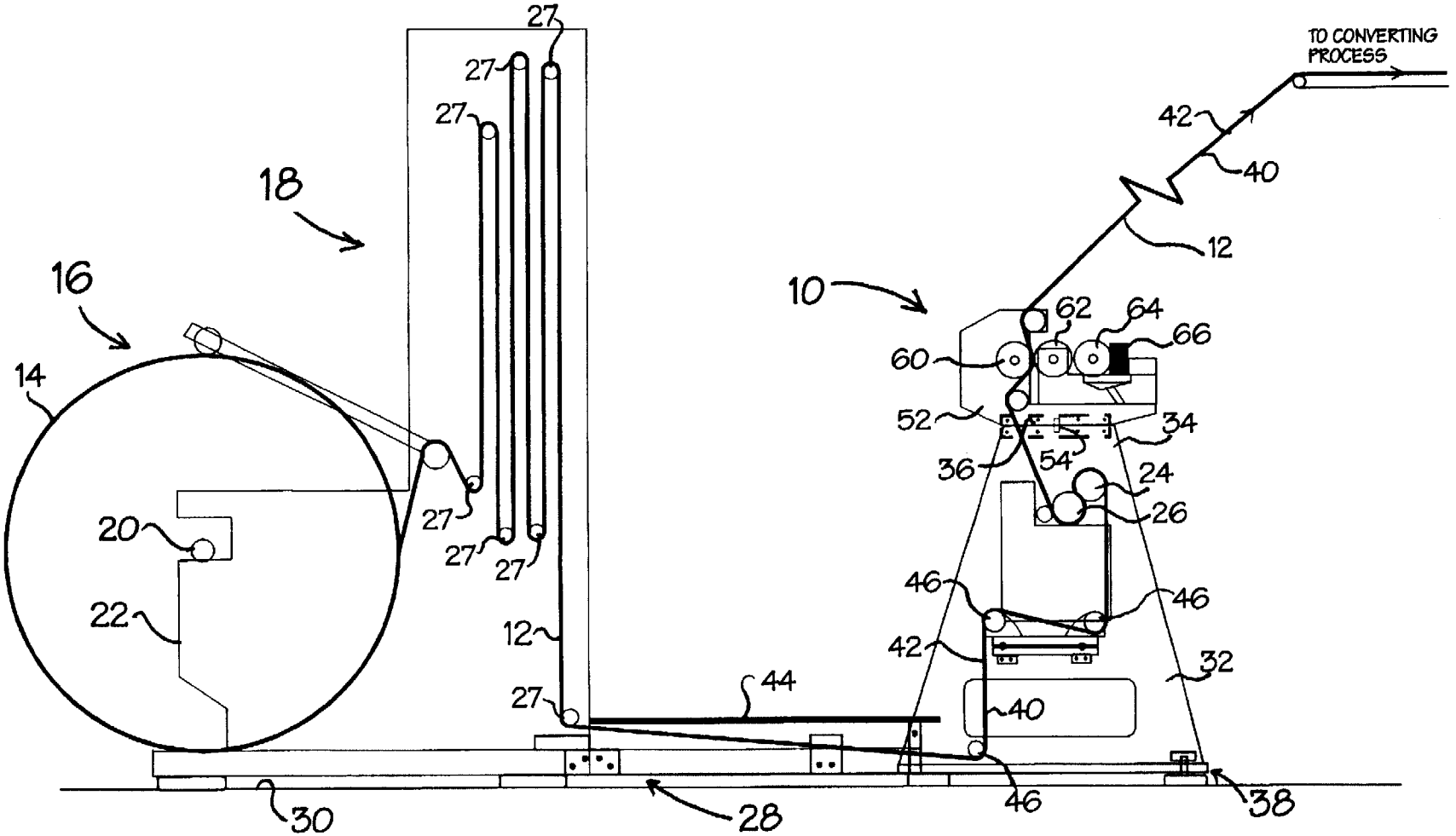
FIG. 2 is a view similar to FIG. 1, illustrating the rotary printer pivoted 180° from the position shown in FIG. 1 for printing the opposite surface of the web material.

The position of the printing unit 10 on the support frame platform 36 is reversible or movable from a first position, as illustrated in FIG. 1, through an angle of 180° to a second position, as illustrated in FIG. 2. In the position shown in FIG. 1, the web material is printed on the second or inside surface 42. By merely reversing the position of the printer 10 on the platform 36 to the position shown in FIG. 2, the first or outside surface 40 of the web is printed.

The web material 12 is fed to the printing unit 10 by unwinding the roll 14 and maintaining a uniform tension on the web material 12 as it is fed through the unwind unit 18. From the unwind unit 18, the material 12 is fed beneath a step plate 44 that extends above the support frame 28 between the unwind unit 18 and the frame upstanding member 32. The step plate 44 overlies the web 12 to protect the web from damage as it is fed from the unwind unit 18 to the printer 10. Mounted on the printer support frame member 32 are a series of guide rolls 46 that direct the web to the printing unit 10.

The continuous web 12 is unwound at a preselected linear speed from the supply roll 14 by the pair of pull rolls 24 and 26. The pull rolls 24 and 26 are rotatably journaled in the support frame member 32. The continuous web 12 passes between the pull rolls 24 and 26 which frictionally engage and exert tension on the web 12. A selected one of the rolls, for example roll 26, is rotated at a preselected speed to generate a selected linear feed rate of the web 12. The pull rolls 24 and 26 combine to pull the web from the supply roll 14 and feed the web 12 to the envelope machine for converting the printed web into cut and folded envelopes.

Figure 9:
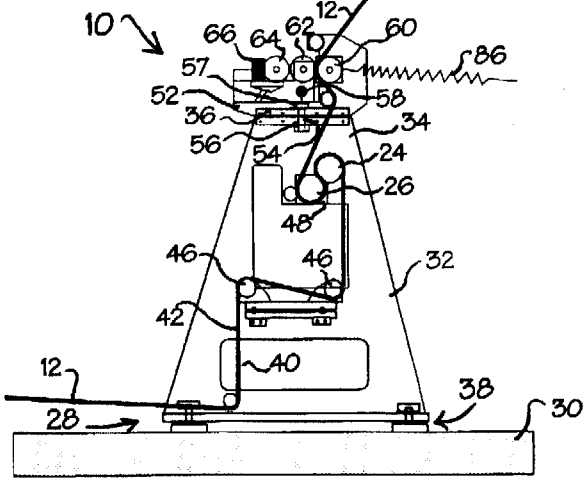
FIG. 9 is a schematic view in side elevation of a rotary printer positioned on a support frame for printing either surface of the web material, illustrating a servo drive connected to the impression cylinder.

The drive mechanism for the pull rolls 24 and 26 is selective. For example, in one embodiment, as will be explained later in greater detail in FIG. 9 in which like numerals designate like elements shown in FIGS. 1–4, the driven pull roll 26 is drivingly connected in a conventional manner to an output shaft of a servo-motor 48. The servo-motor 48 is electrically connected to a servo drive that is operated by a controller (not shown) which is microprocessor controlled to receive input from the machine operator for setting the linear feed rate of the web 12. A selected one of the pull rolls 24 and 26 can also be driven by a conventional drive shaft 50, as illustrated in FIGS. 13–18, which will also be described later in greater detail.

The printing unit 10 of the present invention is not limited to use with envelope making machines and is operable in other types of printing presses, such as conventional web perfecting presses as disclosed in U.S. Pat. No. 3,616,751. The present invention is operable in offset printing, flexo printing, doctor blade printing, UF printing, and other printing operations beyond those used in envelope making.

As illustrated in FIGS. 1 and 2 and in greater detail in FIGS. 5, 6, 12, and 16 the printing unit 10 is pivotally mounted on the horizonal platform 36 of frame 32 for movement through 180° to reverse the position of the printer modules for printing on either side of web material. The printing unit 10 includes a base 52 that is positioned for movement on the horizonal platform 36 of the upstanding frame 32. A pivot pin 54 is journaled in aligned holes extending through the platform 36 and base 52. The pin 54 pivotally connects the base 52 to the platform 36. With this arrangement the modules of the printing unit 10 can be reversed in position on the printer frame 32, as shown in FIGS. 1 and 2.

The base 52 is secured in position on the platform 36 by a mechanism that locks the base 52 on platform 36 to prevent relative movement therebetween. The locking mechanism, as shown in detail in FIGS. 12 and 16 for two embodiments of the printer drive, includes a pair of lock screws 56 each connected at one end by a nut 57 to an actuator 58 that turns the nut 57 on the screw 56. The opposite end of each screw 56 is pivotally connected to a boss 59 that extends from the bottom of platform 36. For purposes of illustration only, the screw 56 is shown in both an engaged or clamped position and a disengaged or unclamped position in FIGS. 12 and 16.

In the clamped position the screws 56 are pivoted unwardly from a position extending below the platform 36 to a position where the nuts 57 abut the base 52. The actuators 58 are then turned to advance the nuts 57 on the screws 56 into clamping engagement with the base 52. Continued rotation of actuators 58 urge the base 52 by the nuts 57 into clamping engagement with the platform 36. The nuts 57 are turned until the base 52 is immovably clamped to the platform 36.

By loosening the nuts 57 on the screws 56, the screws 56 are free to pivot downwardly to release the base 52 from clamping engagement with the platform 36. The base 52 is then free to pivot through at least 180° about a vertical axis formed by the pivot pin 54. Provided at the lateral edges of the overlying base 52 and platform 36 are aligned recesses (not shown) to receive the screws 56. When the screws 56 are pivoted into locked position, they move into the recesses on the side edges of base 52 and platform 36. Then the nuts 57 advance downwardly on the screws 56 when the actuators 58 are turned.

The printing unit 10 is movable between a first position for printing, for example, on the inside surface 42 of the web as shown in FIG. 1. Then when the base 52 is turned or pivoted through 180° on the platform 36 to the position shown in FIG. 2, the unit 10 is in position to print on the outside surface 40 of the web. Then to reverse the printer position the actuator 58 is turned to move the nuts 57 on the lock screws 56 to release the clamping engagement of the platform 36 with the base 52. The nuts 57 are turned until the screws 56 are free to pivot downward and release the base 52 from clamped engagement with the platform 36. The base 52 is then free to turn on the platform 36. When the lock screws 56 are in the engaged or locked position, the base 52 is restrained from movement on the platform 36.

The modules that make up the printing unit 10 are rigidly supported on the base 52 so that they move with the base 52 between the positions for reversing the printing as shown in FIGS. 1 and 2. It should be understood that the printing unit 10 includes any arrangement of printing modules for the respective type of printer, such as, web-fed printer, offset printer, multicolor perfecter printer, and the like.

For purposes of illustration in an envelope making machine, the printing unit 10 shown in the figures is representative of doctor blade printing. The various modules that comprise the printing unit 10 include cylinders that are rotatably journaled on the base 52. The supports and drive connections for the various print cylinders are conventional.

In doctor blade printing of continuously fed web material 12, a driven impression cylinder 60 is rotatably journaled on the printing unit 10. A type or plate cylinder 62 is positioned opposite or adjacent to the impression cylinder 60. The web material 12 passes between the impression cylinder 60 and the plate cylinder 62 to transfer an inked image on the plate cylinder 62 onto the selected surface of the web material 12. In one example, the impression cylinder 60 rotates in a counterclockwise direction and the plate cylinder 62 rotates in an opposite or clockwise direction.

Mounted adjacent to the plate cylinder 62 is an anilox roll 64. The anilox roll 64 is arranged to rotate in a clockwise direction which is the same direction of rotation as the plate cylinder 62. A doctor blade assembly 66 is also positioned on the base 52 and includes a conventional doctor blade (not shown) for distributing a supply of ink from an ink supply (not shown) provided on the base 52 onto the surface of the anilox roll 64. The anilox roll 64 rotates against a blade edge of the doctor blade assembly 66 to transfer a film of ink to the anilox roll 64.

As the anilox roll 64 rotates, the doctor blade assembly 66 removes the excess ink from the surface of the roll 64 and distributes the ink along the entire surface of the anilox roll 64. The rotating anilox roll 64 with a preselected thickness of ink film thereon deposits the ink on the plate cylinder 62. Rotation of the plate cylinder 62 impresses the ink raised type on the surface of the web material 12 as it is conveyed by the impression cylinder 60 at the location where the impression cylinder 60 and the plate cylinder 62 are in juxtaposition with each other.

With the above-described arrangement the web material 12 is pulled or fed between the impression cylinder 60 and the plate cylinder 62 at a speed determined by a rate of rotation of the impression cylinder 60. Rotation of the impression cylinder is generated in one embodiment, as illustrated in FIGS. 9–12, by a servo-motor and in another embodiment, as illustrated in FIGS. 13–16, by a conventional drive shaft 50.

Figure 5:
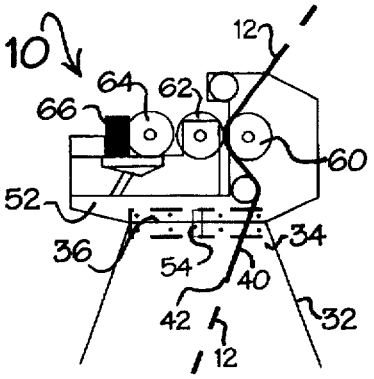
FIG. 5 is a schematic view in side elevation of the rotary printer mounted in a first position, as shown in FIG. 1, on the support frame for printing one surface of the web.

With each revolution of the plate cylinder 62, an image is transferred onto the surface of the web material 12 positioned oppositely of the plate cylinder 62. With the position of the printing unit 10 on the printer frame platform 36, as illustrated in FIGS. 1 and 5, the plate cylinder 62 transfers an image onto the first or inside surface 42 of the web 12. After printing on the inside surface 42 is completed, the base 52 is unlocked from the platform 36 for printing on the reverse side 40 of the web 12, as shown in FIGS. 2 and 6.

To reverse the side of the web that is printed, drive to the pull rolls 24 and 26 is interrupted to stop feeding of the web material 12 from the roll 14. The printer base 52 is then unlocked from its clamped connection to the frame platform 36. The web is cut at a point above the pull rolls 24 and 26 before it enters the printing unit 10. The printing unit 10 is then rotated about the vertical axis of the pivot pin 54 by movement of the base 52 on the platform 36 through 180°.

Figure 6:
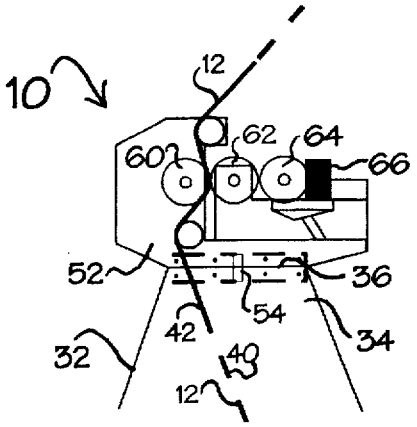
FIG. 6 is a schematic view similar to FIG. 5, illustrating the rotary printer pivoted to a second position, as shown in FIG. 2, on the frame for printing the opposite surface of the web.

To convert or reverse the position of the printing unit 10 from inside printing shown in FIG. 1 to outside printing shown in FIGS. 2 and 6, the unit is turned 180° on the platform 36. After the printing unit is moved to the position shown in FIGS. 2 and 6, the base 52 is again locked into clamping engagement with the platform 36 by moving the lock screws 56 into position for advancing the nuts 57 on the screws 56 to clamp the base 52 to the platform 36. The separated ends of the web material 12 are then spliced together, and the unit 10 is ready for outside printing of the web material 12.

Figure 3:
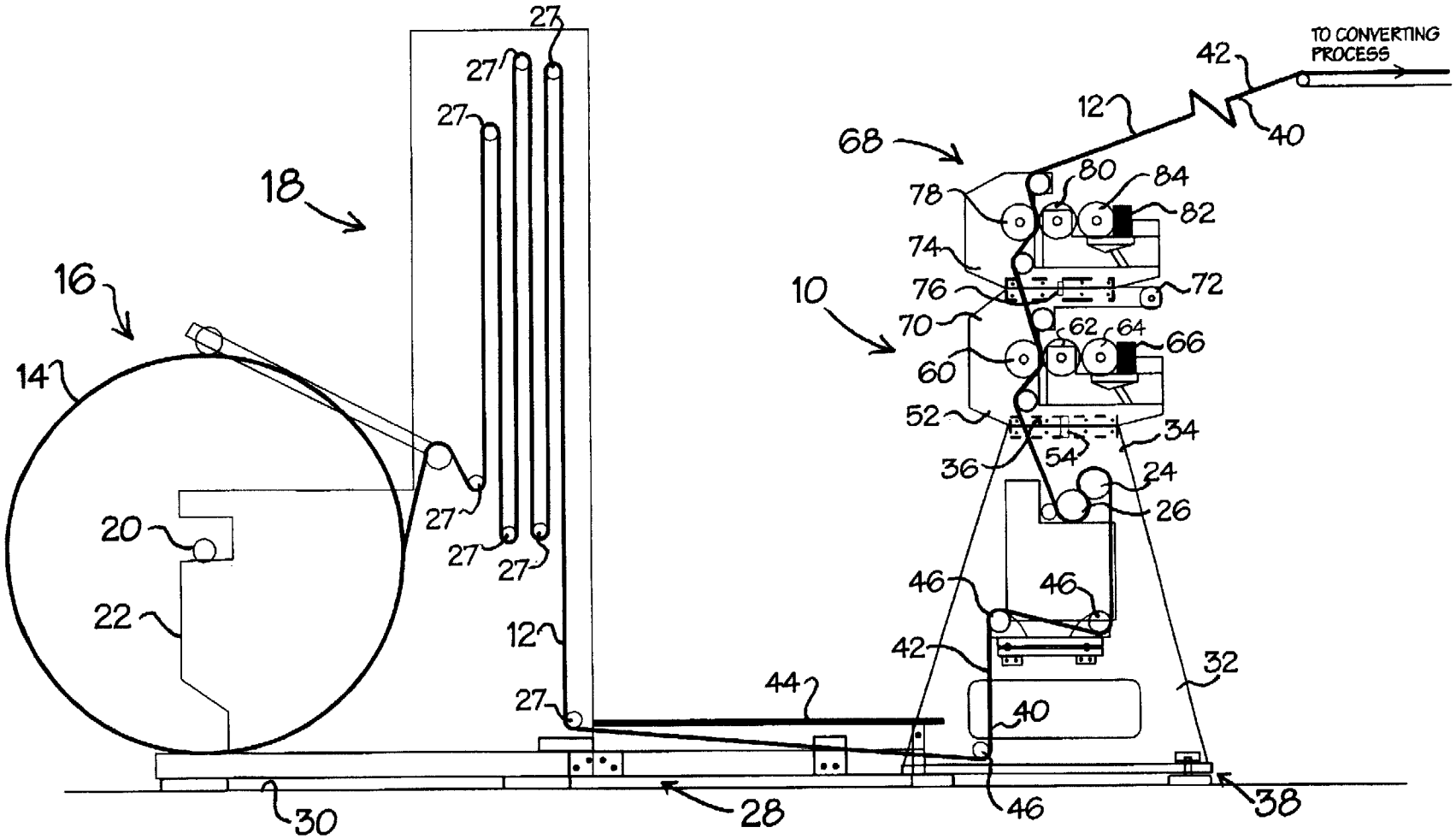
FIG. 3 is a view in side elevation of a web feeder and printer for an envelope making machine, illustrating a pair of pivotally supported rotary printers mounted in tandem on a frame for two color printing the same surface of the web.
Figure 7:
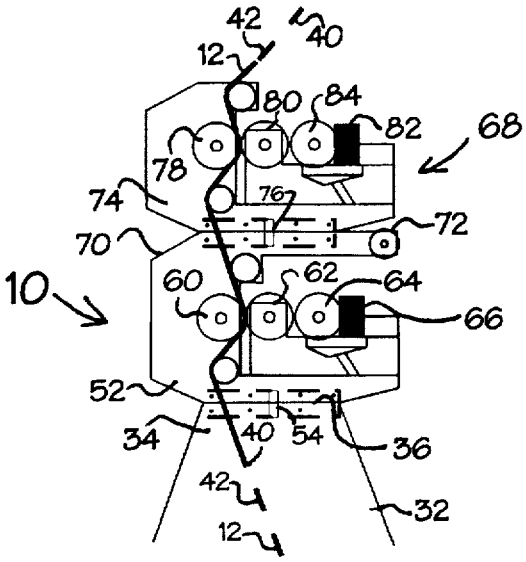
FIG. 7 is a schematic view in side elevation of a pair of rotary printers mounted in tandem for printing the same surface of the web, as shown in FIG. 3.

Referring to FIGS. 3 and 7, in which like numerals refer to like elements shown in FIGS. 1 and 2, there is illustrated a tandem pair of printing units 10 and 68 mounted on the printer support frame 32. The tandem arrangement of printing units 10 and 68 is utilized for two color printing on one or both surfaces 40 and 42 of the web material 12. As discussed above, the printing unit 10 is reversible in position on the platform 36 of frame member 32. The printing unit 68 is reversible in position on the printing unit 10.

The pivotal connection of the printing unit 10 to the frame member platform 36 by the pivot pin 54 in FIG. 3 is identical to that described above for the printing unit 10 illustrated in FIG. 1. The same arrangement facilitates pivotal movement of the printing unit 68 on the printing unit 10. This is accomplished by a bracket 70 extending upwardly from the base 52. The bracket 70 has an upper end portion forming a horizonal platform 72. Resting on the platform 72 is a movable base 74 of the printing unit 68. A pivot pin 76 is journaled in aligned bores of the horizonal platform 72 and base 74 to permit pivotal movement of the base 74 on the horizonal platform 72 through 180° from the position illustrated in FIG. 3 to the position illustrated in FIG. 4.

The horizonal platform 72 and base 74 are also locked in position by the provision of a locking mechanism including the lock screws 56, nuts 57 and actuators 58 discussed above and illustrated in FIG. 12. This locking mechanism is not shown in FIGS. 3 and 4, but it should be understood that the same locking mechanism that is used to secure the base 52 to the platform 36 for the printing unit 10 is used to secure the base 74 to the platform 72 for the printing unit 68.

The printing unit 68 also includes the same printing modules as the unit 10. Specifically, a driven impression cylinder 78 is rotatably supported on a bracket that extends upwardly from the base 74. A plate cylinder 80 is positioned adjacent to the impression cylinder 78. The web material 12 passes between the impression cylinder 78 and the plate cylinder 80. A doctor blade assembly 82 also mounted on the base 74 transfers a film of ink to an anilox roll 84 mounted on the base 74. With a selected thickness of ink film on the anilox roll 84, rotation of the anilox roll 84 deposits ink on the plate cylinder 80. Rotation of the plate cylinder 80 impresses the inked image on the surface of the web material.

For the position of the printing unit 68, shown in FIGS. 3 and 7, the plate cylinder 80 applies an inked image to the first or outside surface 40 of the web material 12. The first or outside surface 40 is also printed by the printing unit 10 shown in FIG. 3. With this arrangement both printers 10 and 68 perform two color printing on the first or outside surface 40 of the web 12 to be cut into envelope blanks after printing and then folded into envelopes of a preselected configuration.

Figure 4:
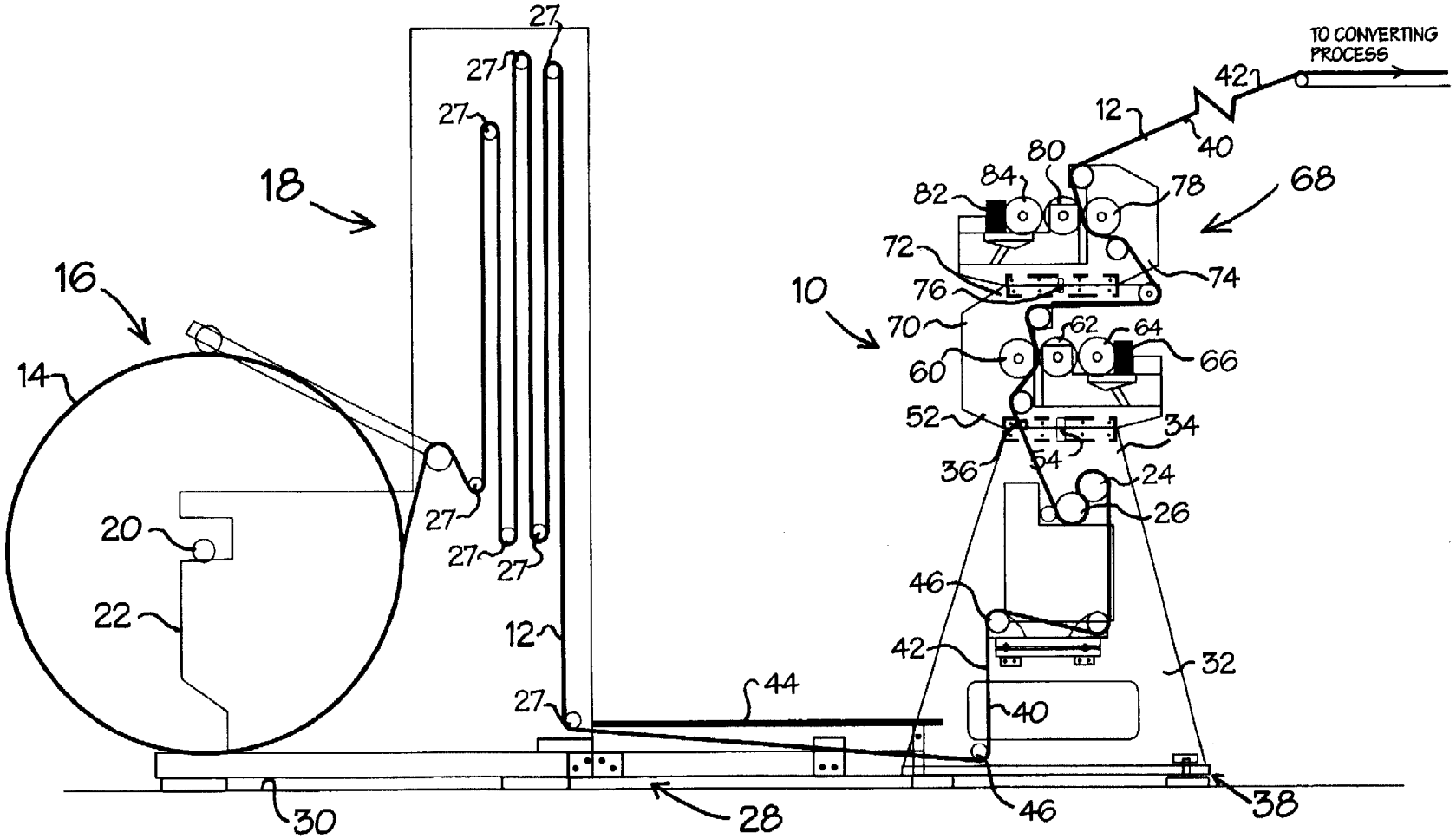
FIG. 4 is a view similar to FIG. 3, illustrating the tandem printers positioned on the frame for two color printing on opposite surfaces of the web.
Figure 8:
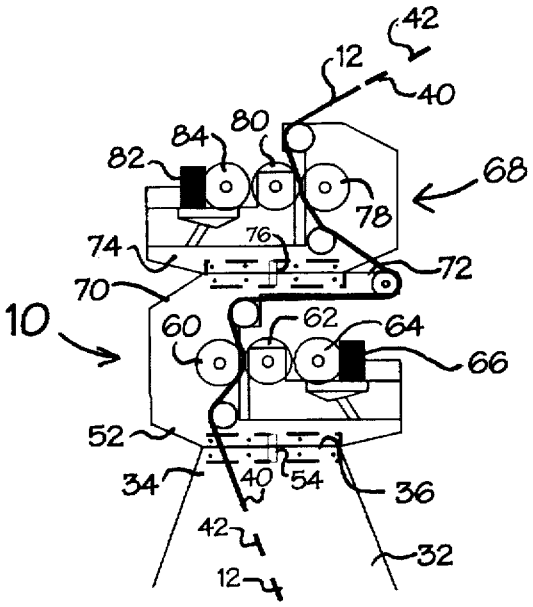
FIG. 8 is a schematic view similar to FIG. 7, illustrating the upper printer in the tandem arrangement pivoted to a position, as shown in FIG. 8, on the support frame for printing the opposite surface of the web as the lower printer.
Figure 11:
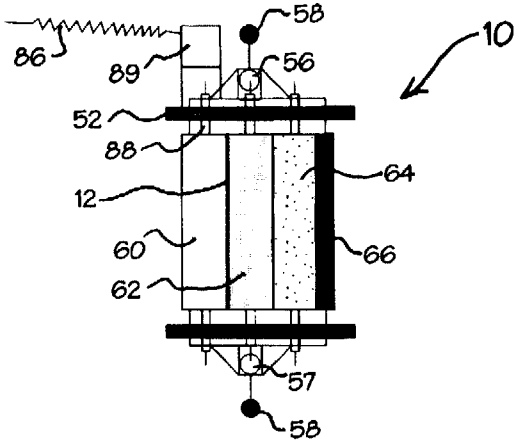
FIG. 11 is a top plan view similar to FIG. 10, illustrating the rotary printer pivoted 180° on the support frame for printing the opposite surface of the web shown in FIG. 10.
Figure 12:
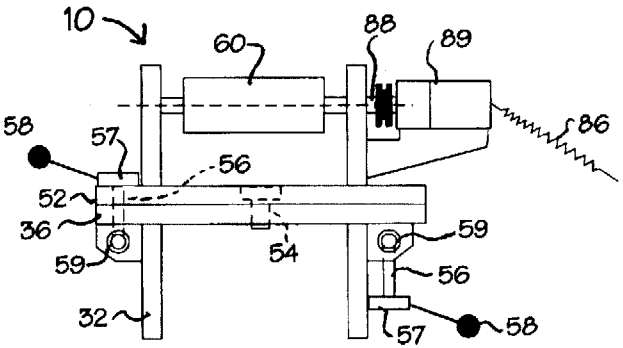
FIG. 12 is a schematic end view of the reversible rotary printer shown in FIG. 10, illustrating the pivotal connection of the printer to the support frame and the mechanism for locking the printer in position on the frame.

FIGS. 4 and 8 illustrate reversal of the position of the printing unit 68 from the position illustrated in FIGS. 3 and 7. As illustrated in FIGS. 4 and 8, the lower printing unit 10 is retained in position for printing the first or outside surface 40 of the web 12. The upper printing unit 68 is positioned to print the second or inside surface 42 of the web 12. The reversal of the printing unit 68 from the position illustrated in FIGS. 3 and 7 to the position illustrated in FIGS. 4 and 8 is accomplished in the same manner as above-described for reversing the position of the single printer 10 from the position shown in FIG. 1 to the position shown in FIG. 2.

To reverse the surface of printing, the feed of the web 12 to the printing units 10 and 68 is interrupted. The base 74 of the printing unit 68 is unlocked from its engagement with the platform 72. The web is then cut at a point between the printing units 10 and 68. The printing unit 68 is then rotated about the pivotal axis of the pin 76 on the platform 72 through 180° to the position shown in FIGS. 4 and 8.

Once in the reversed position, the horizonal platform 72 and base 74 are locked into engagement, and the cut web ends are spliced together. At this point, the printing operation is commenced for printing on opposite surfaces of the web. The printing unit 10 prints on the outside surface 40, and the printing unit 68 prints on the inside surface 42 of the web 12. Accordingly, with the tandem arrangement of reversible printers 10 and 68 both printers can be positioned to print on the same surface of the web or opposite surfaces of the web.

As discussed above and illustrated in detail in FIGS. 9–12 the impression cylinder 60 is connected to an output shaft 88 of a servo-motor 89. The servo-motor 89 includes a gear reducer and is electrically connected by a recoil power cord 86 to a servo-drive and controller (not shown). The controller is responsive to commands received from the machine operator.

The recoil power cord 86 has sufficient length and flexibility to allow the printing unit 10 to be rotated 180° about the vertical axis of the pivot pin 54. From the impression cylinder 60 rotation is transmitted by suitable drive gearing to the plate cylinder 62 and anilox roll 64. The cylinder 62 and the roll 64 are rotated in the same direction but in a direction opposite to the direction of rotation of the impression cylinder 60. Again, the drive gearing from the impression cylinder 60 to the plate cylinder 62 and roll 64 is conventional and will not be described in detail. Because the drive gearing is mounted on the base 52 it also moves with the other components.

Figure 10:
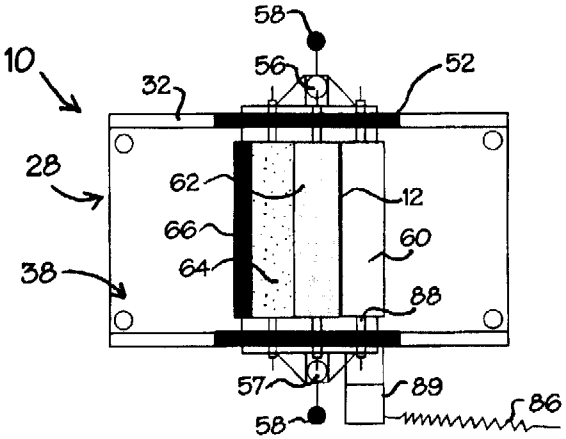
FIG. 10 is a top plan view of the rotary printer shown in FIG. 9, illustrating the servo drive connected to the impression cylinder.

FIG. 10 illustrates the servo-motor 89 positioned for printing as shown in FIG. 1 on the second or inside surface 42 of the web 12. For printing the opposite side of the web material 12, the printing unit is rotated 180° to the position shown in FIG. 11. The servo-motor 89 moves with the printing unit 10 because it is connected to the impression cylinder 60.

Figure 13:
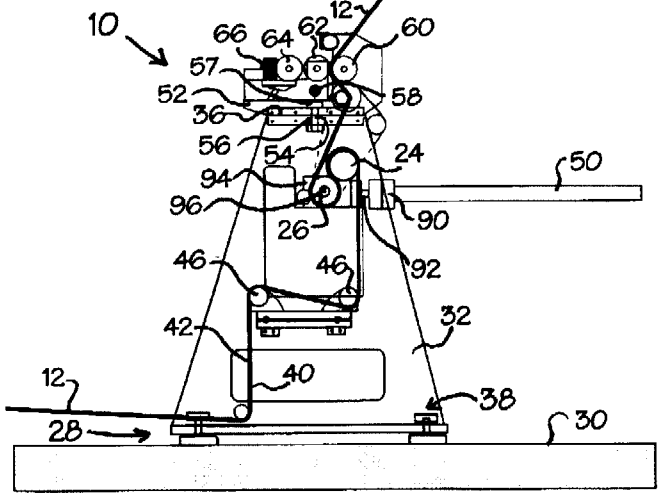
FIG. 13 is a schematic view in side elevation of the rotary printer similar to FIG. 9, illustrating a conventional drive shaft for transmitting rotation to the impression cylinder.

Referring to FIGS. 13–16, there is illustrated the embodiment for transmitting drive to the printing unit 10 by a conventional drive shaft and gear box arrangement. The drive shaft 50 is drivingly connected to the envelope machine drive (not shown). The drive shaft 50 is connected by coupling 90 to an input shaft 92 of a gear box 94. The gear box 94 includes a pair of output shafts 96 and 98 that extend in a "T" arrangement, as shown in FIGS. 13 and 17, respectively.

As shown in FIG. 13, the output shaft 96 is drivingly connected to the pull roll 26. The output shaft 98 on the opposite side of the gear box 94 is drivingly connected to a gear belt pulley 100 shown in FIG. 17 that transmits rotation via gear belt 102 to gear belt pulley 104. The gear belt pulley 104 is nonrotatably connected to gear 106 which in turn meshes with gear 108. The gear belt pulley 104 and gear pairs 106 and 108 are supported on the frame 32. Thus, the gear belt 102, gear belt pulley 104, and gears 106 and 108 remain stationary on the fixed frame member 32 during the movement of the printing unit 10 between the two positions. The gears 106 and 108 also remain in driving engagement with each other.

Figure 15:
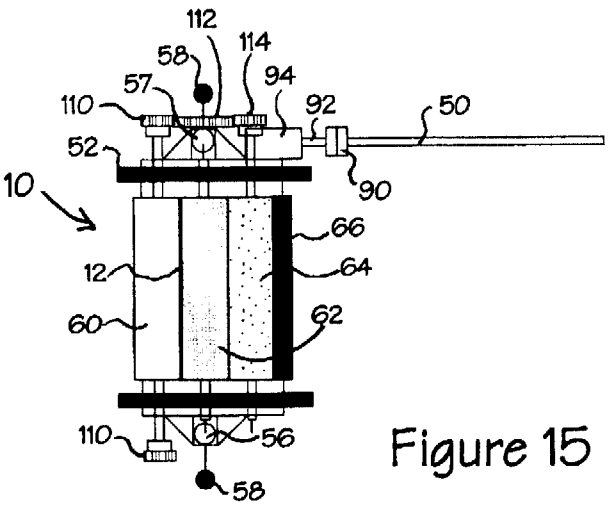
FIG. 15 is a top plan view similar to FIG. 14, illustrating the rotary printer pivoted 180° on the support frame for printing the opposite surface of the web shown in FIG. 14.
Figure 16:
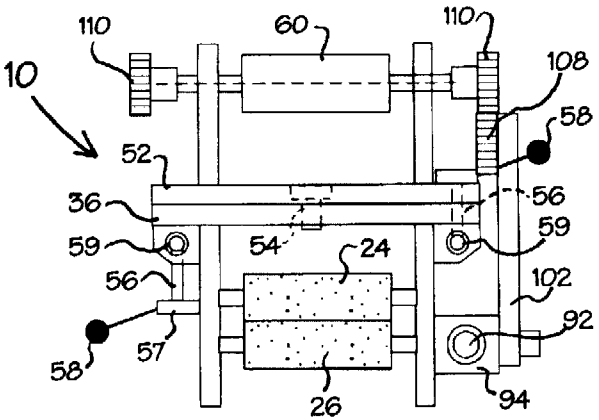
FIG. 16 is a schematic end view of the rotary printer shown in FIG. 14, illustrating the drive connection from the drive shaft to the impression cylinder.
Figure 14:
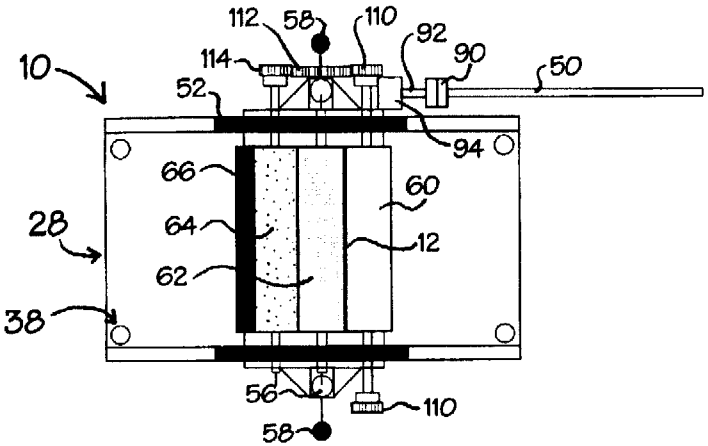
FIG. 14 is a top plan view of the rotary printer shown in FIG. 13, illustrating the drive connection from the drive shaft to the impression cylinder.
Figure 17:
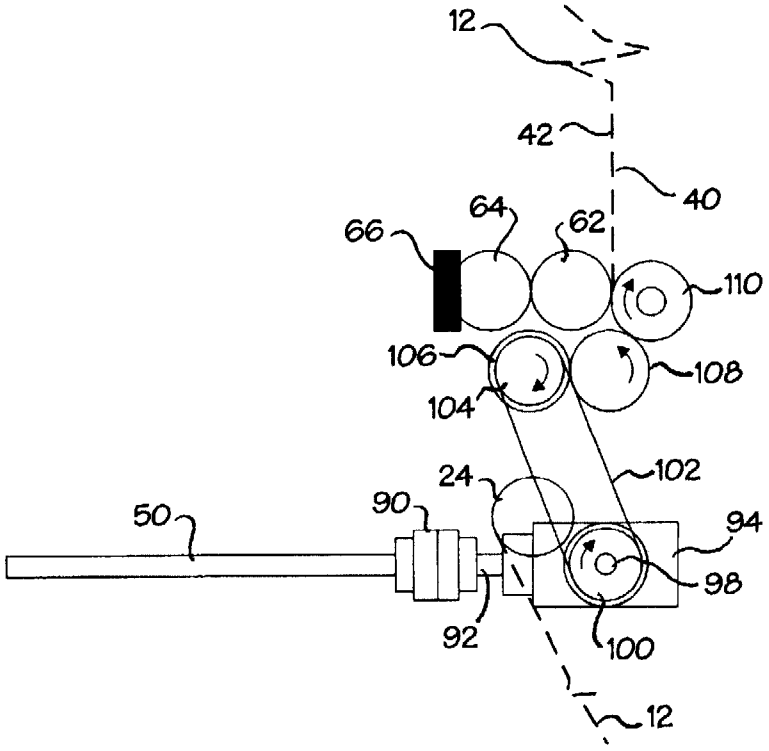
FIG. 17 is a schematic illustration in side elevation of the drive connection from a drive shaft to the reversibly positioned rotary printer, illustrating the impression cylinder positioned on the support frame for printing an inside surface of the web.

The printing unit 10 for the drive shaft arrangement shown in FIG. 17 is positioned for inside printing of the web 12. The gear 108 drivingly engages a gear 110. A gear 110 is nonrotatably connected to each end of the impression cylinder 60, as shown in FIGS. 14 and 15. From the impression cylinder gear 110 rotation is transmitted to the meshing gears 112 and 114 of the plate cylinder 62 and the anilox roll 64, respectively, for rotation of the cylinder 62 and roll 64, as shown in FIG. 14. For purposes of clarity of illustration, the meshing gears 112 and 114 are not shown in FIG. 17. However, the cylinder 62 and roll 64 are schematically illustrated in FIG. 17.

Figure 18:
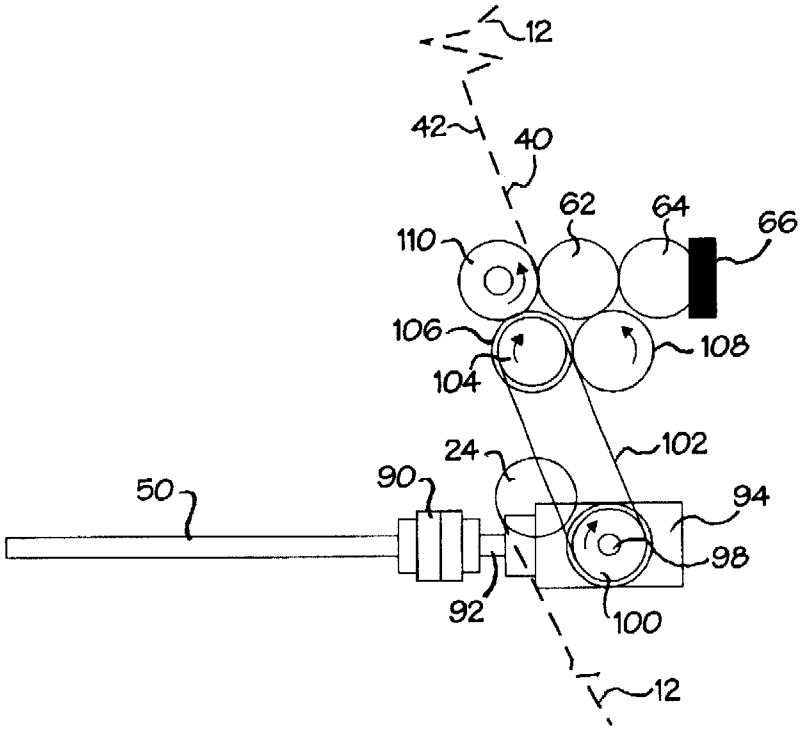
FIG. 18 is a view similar to FIG. 17, schematically illustrating the drive connection to the impression cylinder positioned on the support frame for printing an outside surface of the web.

When it is desired to reverse the printing unit 10 shown in FIG. 17 to the position shown in FIG. 18 for printing the opposite or outside surface 40 of the web 12, the gears 106 and 108 remain fixed. The impression cylinder 60 turns with the base 52 so that the gear 110 on the opposite end of the impression cylinder 60 is moved into meshing engagement with gear 106. For outside printing the gear 106 turns gear 110 to rotate the impression cylinder 60. Then rotation is transmitted by gear 110 to the gears 112 and 114 associated with the plate cylinder 62 and anilox roll 64, respectively. Again, gears 112 and 114 are not shown in FIG. 18, but are shown in FIG. 15.

Also, it should be understood, as shown in FIG. 18, that the gear 108 meshes only with gear 106. There is no drive connection from the gear 108 to the plate cylinder 62 or anilox roll 64. For the embodiment shown in FIG. 18, rotation to cylinder 62 and roll 64 is transmitted from gear 106 to gear 110 on cylinder 60 and therefrom to gears 112 and 114 for cylinder 62 and roll 64.

In the position shown in FIG. 17 for inside printing of the web 12, rotation is transmitted to the impression cylinder 60 from gears 106 and 108 to gear 110. For outside printing, as shown in FIG. 18, rotation is transmitted to the impression cylinder 60 from the gear 106 turning gear 110. Gear 106 also turns gear 108, but gear 108 is not used to transmit rotation to the impression cylinder 60 in the position shown in FIG. 18.

With the present invention, a wide variety of rotary printers are utilized to print both surfaces of web material without the need for providing alternate impression and plate cylinders for movement into and out of position relative to the web. By reversibly positioning the printing unit on a support frame, a single arrangement of printing modules can be utilized with a minimum of downtime and conversion for reversing the printing operation. The present invention does not require rerouting the web through different combinations of cylinders when it is desired to reverse the printing operation from one surface of the web to the other.

With the present invention, both surfaces of the web are printed without wasting paper by unwinding a length of material from the web to redirect it through the printing unit. Converting the printing from one surface to the other is efficiently accomplished. The setup time and change over from inside to outside printing is quickly performed. Not only is the present invention adaptable to many configurations of printing units, it is also operable with both servo-drive systems and conventional drive shaft systems.

According to the provisions of the patent statutes, I have explained the principle, preferred construction and mode of operation of my invention and have illustrated and described what I now consider to represent its best embodiments. However, it should be understood that, within the scope of the appended claims, the invention my be practiced otherwise than as specifically illustrated and described.

I claim:

1. A reversible printer for printing both sides of continuous web material comprising, a support frame having a platform, a printer base positioned on said support frame platform, a rotatably driven impression cylinder supported by said printer base, a rotatably driven plate cylinder supported by said printer base to receive web material fed between said impression cylinder and said plate cylinder for printing, said plate cylinder having an inked surface for transferring an inked image to one side of the web material, and said printer base being pivotally mounted on said support frame platform for movement to reverse the position of said impression cylinder and said plate cylinder to print one side of the web material in a first position of said printer base and the opposite side of the web material in a second position of said printer base pivoted from said first position.

2. A reversible printer for printing both sides of continuous web material as set forth in claim 1 which includes, a pivot pin, said pivot pin being journaled in aligned holes extending through said support frame platform and said printer base, and said pivot pin pivotally supporting said printer base on said support frame platform.

3. A reversible printer for printing both sides of continuous web material as set forth in claim 2 which includes, a locking mechanism releasably engageable with said printer base and said support frame platform, said locking mechanism operable in a clamped position to prevent movement of said printer base on said support frame platform, and said locking mechanism operable in a released position to permit pivotal movement of said printer base about said pivot pin on said support frame platform.

4. A reversible printer for printing both sides of continuous web material as set forth in claim 1 which includes, a servo-motor including an output shaft connected to said impression cylinder for transmitting rotation from said servo-motor to said impression cylinder, drive gearing for transmitting rotation from said impression cylinder to said plate cylinder, said drive gearing being supported by said printer base, and said servo-motor being electrically connected to a power source.

5. A reversible printer for printing both sides of continuous web material as set forth in claim 1 which includes, a drive shaft, said drive shaft being coupled to an input shaft of a gear box, said gear box having a first output shaft and a second output shaft, said first output shaft drivingly connected to a pull roll, said pull roll rotatably supported on said support frame for advancing the web material to said printer base, said second output shaft drivingly connected to a pulley for transmitting rotation to a first gear, said first gear meshing with a second gear, and said drive shaft, said input shaft, said gear box, said first and second output shafts, said pulley, and said first and second gears being supported by said support frame independently of said printer base to allow relative movement therebetween.

6. A reversible printer for printing both sides of continuous web material as set forth in claim 5 in which, said second gear drivingly engages a third gear positioned on said printer base and nonrotatably connected to said impression cylinder when said printer base is in said first position, and said third gear drivingly engaged to a fourth gear nonrotatably connected to said plate cylinder for transmitting rotation from said impression cylinder to said plate cylinder on said printer base.

7. A reversible printer for printing both sides of continuous web material as set forth in claim 5 in which, said first gear drivingly engages said third gear when said printer base is in said second position.

8. A reversible printer for printing both sides of continuous web material as set forth in claim 1 which includes, a bracket extending upwardly from said printer base, said bracket having an upper end portion forming a bracket platform, a second printer base positioned on said bracket platform, a second driven impression cylinder rotatably supported on said second printer base, a second driven plate cylinder rotatably supported on said second printer base to receive web material fed between said second impression cylinder and said second plate cylinder for printing, said second plate cylinder having an inked surface for transferring an inked image to one side of the web material, and said second printer base being pivotally mounted on said horizontal platform for movement to reverse the position of said second impression cylinder to print one side of the web material in a first position of said second printer base and the opposite side of the web material in a second position of said second printer base pivoted from said first position on said second printer base.

9. A method for printing opposite sides of continuous web material comprising the steps of, positioning an impression cylinder and a plate cylinder on a platform to receive web material fed therebetween, rotating the impression cylinder and the plate cylinder in opposite directions to feed the web material therebetween, transferring a film of ink to the surface of the plate cylinder for printing an inked image on one side of the web material as the web material is fed between the impression cylinder and the plate cylinder, and turning the impression cylinder and the plate cylinder 180° on the platform to position the plate cylinder in printing relation with the opposite side of the web material so that when a film of ink is transferred to the plate cylinder the opposite side of the web is printed upon rotation of the impression cylinder and the plate cylinder.

10. A method for printing opposite sides of continuous web material as set forth in claim 9 which includes, supporting the impression cylinder and the plate cylinder by a base, pivotally connecting the base to the platform, and turning the base through 180° to reverse the position of the impression cylinder and the plate cylinder on the platform.

11. A method for printing opposite sides of continuous web material as set forth in claim 9 which includes, locking the impression cylinder and the plate cylinder in a fixed position on the platform.

12. A method for printing opposite sides of continuous web material as set forth in claim 9 which includes, drivingly connecting the impression cylinder and the plate cylinder to a servo-drive mechanism.

13. A method for printing opposite sides of continuous web material as set forth in claim 9 which includes, drivingly connecting the impression cylinder and the plate cylinder to a drive shaft and gear box arrangement.

14. A method for printing opposite sides of continuous web material as set forth in claim 9 which includes, supporting a second impression cylinder and a second plate cylinder on a second platform positioned above the first mentioned impression cylinder and plate cylinder, rotating the second impression cylinder and the second plate cylinder in opposite directions to feed the web material therebetween, transferring a film of ink to the surface of the second plate cylinder for printing a second inked image on the one side of the web material as the web material is fed between the second impression cylinder and the second plate cylinder, and turning the second impression cylinder and the second plate cylinder 180° on the second platform to position the second plate cylinder in printing relation with the opposite side of the web material so that when a film of ink is transferred to the second plate cylinder the opposite side of the web is printed upon rotation of the second impression cylinder and the second plate cylinder.

15. A method for printing opposite sides of continuous web material as set forth in claim 14 which includes, releaseably locking the first and second impression cylinders and the first and second plate cylinders in fixed positions relative to the first mentioned platform and the second platform.

16. A rotary printer for an envelope machine comprising, a support frame having a platform, said support frame receiving a moving web fed from a source, a printer base positioned on said support frame platform, said printer base connected to said support frame platform for pivotal movement through 180° between a first position and a second position, an impression cylinder rotatably supported on said printer base for receiving the moving web on surface of said impression cylinder, a plate cylinder rotatably supported adjacent to said impression cylinder on said printer base for receiving the web fed between said plate cylinder and said impression cylinder, an anilox roll rotatably supported in contact with said plate cylinder on said printer base, a ink distributing mechanism supported by said printer base for transferring a film of ink onto the surface of said anilox roll for transfer to said plate cylinder for printing an image on one side of the web when said printer base is in said first position, drive means for transmitting rotation from said impression cylinder to said plate cylinder and said anilox roll to transfer an inked image on said plate cylinder to the surface of one side of the web moving between said impression cylinder and said plate cylinder, and said printer base upon rotation through 180° to the second position on said support frame platform reverses the position of said impression cylinder and said plate cylinder for printing an image on an opposite side of the web.

17. A rotary printer for an envelope machine as set forth in claim 16 which includes, a pivot pin, said pivot pin being journaled in aligned holes extending through said support frame platform and said printer base, and said pivot pin pivotally supporting said printer base on said support frame platform.

18. A rotary printer for an envelope machine as set forth in claim 16 which includes, a locking mechanism releasably engageable with said support frame platform and said printer base, said locking mechanism operable in a clamped position to prevent relative movement between said printer base and said support frame platform, and said locking mechanism in a released position operable to permit pivotal movement of said printer base on said support frame platform.

19. A rotary printer for an envelope machine as set forth in claim 16 in which, said drive means includes a servo-motor having an output shaft connected to said impression cylinder for transmitting rotation from said servo-motor to said impression cylinder, drive gearing for transmitting rotation from said impression cylinder to said plate cylinder and said anilox roll, said drive gearing being supported by said printer base, and said servo-motor being electrically connected to a power source.

20. A rotary printer for an envelope machine as set forth in claim 16 in which, said impression cylinder is driven by a drive shaft, said drive shaft being coupled to an input shaft of a gear box, said gear box having a first output shaft and a second output shaft, said first output shaft drivingly connected to a pull roll, said pull roll rotatably supported on said support frame for advancing the web material, said second output shaft drivingly connected to a pulley for transmitting rotation to a first gear, said first gear meshing with a second gear, and said drive shaft, said input shaft, said gear box, said first and second output shafts, said pulley, and said first and second gears being supported by said support frame independently of said printer base to allow relative movement therebetween.

* * * * *